US011867061B2

(12) United States Patent
Roberts et al.

(10) Patent No.: US 11,867,061 B2
(45) Date of Patent: Jan. 9, 2024

(54) RESIN INJECTION DOLLY

(71) Applicant: FCI Holdings Delaware, Inc., Wilmington, DE (US)

(72) Inventors: Trent Andrew Roberts, Smeaton Grange (AU); Jeremy Ross Arnot, Smeaton Grange (AU)

(73) Assignee: FCI Holdings Delaware, Inc., Wilmington, DE (US)

( * ) Notice: Subject to any disclaimer, the term of this patent is extended or adjusted under 35 U.S.C. 154(b) by 340 days.

(21) Appl. No.: 17/430,436

(22) PCT Filed: Feb. 13, 2020

(86) PCT No.: PCT/AU2020/050123

§ 371 (c)(1),
(2) Date: Aug. 12, 2021

(87) PCT Pub. No.: WO2020/163916

PCT Pub. Date: Aug. 20, 2020

(65) Prior Publication Data

US 2022/0120182 A1 Apr. 21, 2022

(30) Foreign Application Priority Data

Feb. 13, 2019 (AU) ..... 2019900457

(51) Int. Cl.

| | |
|---|---|
| ***E21D 5/00*** | (2006.01) |
| ***E21D 20/02*** | (2006.01) |
| ***E02D 5/80*** | (2006.01) |

(52) U.S. Cl.
CPC ..... *E21D 20/028* (2013.01); *E02D 5/808* (2013.01)

(58) Field of Classification Search
CPC ..... E21D 20/003; E21D 20/028; E02D 5/808
See application file for complete search history.

(56) References Cited

U.S. PATENT DOCUMENTS 4,588,037 A 5/1986 Combet
5,997,219 A * 12/1999 Krzysztalowicz .. E21D 21/0033 405/259.1

(Continued)

FOREIGN PATENT DOCUMENTS

AU 2014201857 B2 4/2014
CL 199101205 A1 8/1992

(Continued)

*Primary Examiner* — Kyle Armstrong
(74) *Attorney, Agent, or Firm* — The Webb Law Firm

(57) ABSTRACT

A rock bolt dolly (10) which connects a self-drilling rock bolt (300), to a rock bolting apparatus and transfers percussive energy applied to the dolly (10) by the rock bolting apparatus (50) to the rock bolt during installation of the rock bolt in strata and rock is disclosed. The dolly includes coupling means (30*a*, 30*b*) for coupling the dolly to the output shaft of the rock bolting apparatus and a percussion plate (42) comprising an end plate (44) and integral side walls (47) defining an internally threaded recess for receiving the threaded end of the rock bolt, for applying percussive loading to the elongate hollow rod of the rock bolt (300) via the end plate and threaded side walls. The dolly also includes a body portion extending between the coupling means and the percussion plate transmitting forces from the output shaft to the percussion plate; which defines at least one passageway (136) for the passage of grout or resin from a reservoir through the rock bolt dolly and into the rock bolt.

20 Claims, 17 Drawing Sheets

(56) References Cited

U.S. PATENT DOCUMENTS

| | | | | |
|---|---|---|---|---|
| 7,318,689 | B2 | 1/2008 | Kanflod et al. | |
| 9,157,321 | B2 * | 10/2015 | Nystrom | E21D 20/025 |
| 10,253,628 | B2 * | 4/2019 | Faulkner | E21D 20/028 |
| 10,344,593 | B2 * | 7/2019 | Pastorino | E21D 21/0066 |
| 2012/0177448 | A1 | 7/2012 | Steyn et al. | |
| 2014/0140773 | A1 | 5/2014 | Brown | |
| 2017/0184434 | A1 | 6/2017 | Crompton | |

FOREIGN PATENT DOCUMENTS

| | | | |
|---|---|---|---|
| CL | 2011002464 | A1 | 7/2012 |
| CL | 2013003584 | A1 | 8/2014 |
| CL | 2016002903 | A1 | 2/2017 |
| JP | S60144499 | A | 7/1985 |
| WO | 2004099568 | A1 | 11/2004 |
| WO | 2006042530 | A1 | 4/2006 |
| WO | WO2007/059580 | A1 | 5/2007 |
| WO | 2007095690 | A1 | 8/2007 |
| WO | WO2009/092659 | A2 | 7/2009 |
| WO | WO2013/170312 | A1 | 11/2013 |
| WO | 2016141008 | A1 | 9/2016 |
| WO | 2018045277 | A1 | 3/2018 |

* cited by examiner

RESIN INJECTION DOLLY

CROSS-REFERENCE TO RELATED APPLICATIONS

This application is the United States national phase of International Application No.: PCT/AU2020/050123 filed Feb. 13, 2020, and claims priority to Australian Provisional Patent Application No 2019900457 filed Feb. 13, 2019, the disclosures of which are hereby incorporated by reference in their entirety.

TECHNICAL FIELD

This invention relates to a dolly for use in installing rock bolts and to an associated method of installing rock bolts, particularly self-drilling rock bolts, using resins and catalysts to secure the rock bolts in mine walls and roofs.

BACKGROUND

Rock bolts are used in soft and hard underground mines to provide ground support for mined excavations, and in particular are used to support mine walls and roofs.

Installation of conventional rock bolts involves drilling a borehole into the strata to a desired depth using an elongate drilling tool ("the drill steel"), with a drill bit attached to the distal end of the drill steel. Once the hole has been drilled, the drill steel and drill bit are removed from the borehole. In a second step, two component plastic resin cartridges/capsules having one component containing a curable resin composition and another component containing a curing agent (catalyst) are inserted into the borehole either mechanically or by hand. In a third step, a rock bolt with a resin mixing device and nut secured to the rock bolt is loaded onto a rock bolting apparatus in the form of a drilling/bolting machine with the drive dolly of the machine engaging the nut. The machine is aligned with the borehole that contains the resin cartridge. The machine is operated to spin the rock bolt, and the distal free end of the rotating rock bolt is slowly inserted into the borehole, which shreds the resin capsule and mixes the two parts of the resin cartridge together. The mixed resin components cure and solidify and bind/encapsulate the rock bolt in the borehole.

This conventional installation process has a number of drawbacks. First, in poor ground conditions, or where there is low quality rock mass, the bore holes often collapse when the drill steel is removed from the bore hole. When this happens, inserting a resin capsule and rock bolt into the collapsed borehole is difficult and sometimes impossible, so conventional rock bolt installation methods cannot be used in such poor ground conditions.

Another commonly used method of installing rock bolts involves using a self-drilling rock bolt which uses a sacrificial drill bit attached to a hollow rock bolt. This allows rock bolts to be used in poor ground conditions where the self-drilling rock bolt acts as the drill steel and remains in the borehole after drilling. Using this method, there are often difficulties in uncoupling the installation dolly used to install the rock bolt from the self-drilling rock bolt, if the rock bolt is not properly engaged with or locked into the borehole. A secondary related issue arises where the boreholes are vertical or greater than horizontal, where the rock bolts have a tendency to drop out of the borehole when they are disconnected from the dolly, if they are not properly engaged with or locked into the borehole.

Self-drilling rock bolts are cement grouted or resin injected to lock them into the borehole and this involves a further step of connecting adaptors and setting up additional pumping equipment to inject the self-drilling rock bolt with resin or cement to lock it into the bore hole.

The present invention seeks to at least address some of the deficiencies of existing methods and provide for efficient and reliable rock bolt installation.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

According to a first broad aspect the present invention provides a method of installing a rock bolt comprising:

- drilling a borehole in strata or rock using a self-drilling rock bolt connected to a bolter boom or the like via a dolly;
- while the self-drilling rock bolt remains in the borehole, and preferably remains engaged with the self drilling rock bolt, injecting grout into the borehole via the dolly and the self drilling rock bolt; and
- disconnecting the self-drilling rock bolt from the dolly.

Typically, the grout comprises resin and a catalyst and the method further comprises:

- supplying the resin via a resin pathway in the dolly; and
- supplying the catalyst via a catalyst pathway in the dolly, separate from the resin pathway.

It is preferred that the resin passageway in the dolly has a diameter of at least about 10 mm and the resin has a viscosity of between 100,000 and 400,000 centipoise and preferably 125,000 to 225,000 centipoise.

It is preferred that the resin is a polyester resin, preferably including from 10 to 25% by weight of an inert filler, such as limestone.

The method may further include the step of disconnecting the rock bolt from the dolly after the resin has cured and flushing the dolly with water via a passageway in the dolly.

In related aspect, there is provided a rock bolt dolly arranged to connect a self-drilling rock bolt including a elongate hollow rod defining at least one externally threaded end, to a rock bolting apparatus and arranged to transfer percussive energy applied to the dolly by the rock bolting apparatus to the rock bolt during installation of the rock bolt in strata and rock, the dolly comprising:

- coupling means for coupling the dolly to the output shaft of the rock bolting apparatus;
- a percussion plate comprising an end plate and integral side walls defining an internally threaded recess for receiving the threaded end of the rock bolt, for applying percussive loading to the elongate hollow rod of the rock bolt via the end plate and threaded side walls;
- a body portion extending between the coupling means and the percussion plate transmitting forces from the output shaft to the percussion plate; wherein the body portion defines at least one passageway for the passage of grout from a reservoir through the rock bolt dolly and into the rock bolt.

Preferably, the body portion defines at least two passageways, one passageway for supplying catalyst and one passage way for supplying resin to the rock bolt.

The diameter of the passageway for supplying resin is preferably at least about 10 to 20 mm diameter, most preferably at least 10 to 15 mm diameter.

The body portion may further define a passageway for supply of water to the percussion plate.

Grout may be supplied to the passageway in the body portion via a rotary housing which extends around the body portion and is rotatable relative to the body portion and which is prevented from rotating relative to the output shaft to provide a non-rotating connection point for one or more hoses for supplying grout to the dolly.

Typically, the rotary housing defines an annular passageway which is in constant fluid connection with a radial inlet in the body portion of the dolly.

Where the body portion defines at least two passageways, one passageway for supplying catalyst and one passageway for supplying resin to the rock bolt, the resin and catalyst may be supplied to the passageways in the body portion via a rotary housing which extends around the body portion and is rotatable relative to the body portion and which is prevented from rotating relative to the output shaft to provide a non-rotating connection point for a hose for supplying grout to the dolly.

In this embodiment, the rotary housing defines a first annular passageway which is in constant fluid connection with a first radial inlet to the catalyst passageway in the body portion of the dolly and a second annular passageway which is in constant fluid connection with a second radial inlet to the resin passageway in the body portion of the dolly.

Advantageously, the present invention may allow an operator to use percussive energy to drill rock bolts into strata and rock and directly inject grout such as a two part resin (resin and catalyst) directly into the rock bolt and borehole to encapsulate the rock bolt within the borehole without having to disengage the rock bolt from the installing dolly until the end of the installation process, using a single pass installation method. This method is not only more reliable as it avoids the issues of collapsing boreholes and disengaging rock bolts from known prior art installation methods it is also more efficient and quicker as there are fewer installation steps and the rock bolt is only attached and detached from the dolly/bolting machine once.

The percussive plate allows percussive forces to be transferred directly to the elongate rod of the self-drilling rock bolt for efficient and effective drilling.

The resin pathway allows for the passage of polyester resins which have a greater viscosity than polyurethane resins.

A related aspect of the invention provides a method of using a dolly to install a self-drilling rock bolt in strata and/or rock, the self drilling rock bolt including a elongate hollow rod defining at least one externally threaded end, the method using the dolly to transfer percussive energy applied to the dolly by the rock bolting apparatus to the rock bolt during installation of the rock bolt in strata and rock, wherein the dolly comprises:

coupling means coupling the dolly to the output shaft of the rock bolting apparatus;

a percussion plate comprising an end plate and integral side walls defining an internally threaded recess for receiving the threaded end of the rock bolt, for applying percussive loading to the elongate hollow rod of the rock bolt via the end plate and threaded side walls;

a body portion extending between the coupling means and the percussion plate transmitting forces from the output shaft to the percussion plate; wherein the body portion defines a first passageway having a diameter of for the passage of resin through the rock bolt dolly and into the rock bolt, and a second passageway for the passage of catalyst through the rock bolt dolly and into the rock bolt, wherein the diameter of the first passageway is at least about 10 mm, the method including the steps of:

drilling a borehole in strata and/or rock using the self-drilling rock bolt connected to the rock bolting apparatus via the dolly;

while the self-drilling rock bolt remains in the borehole, injecting resin into the borehole and rock bolt via the first passage passageway in the dolly and injecting catalyst into the borehole and rock bolt via the second passage passageway in the dolly wherein the resin comprises a polyester resin having a viscosity of from 100,000 to 400,000 centipoise; and disconnecting the self-drilling rock bolt from the dolly.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Specific embodiments of the present invention will now be described, by way of example only, and with reference to the accompanying drawings, in which: —

DESCRIPTION OF EMBODIMENTS

Figure 1:
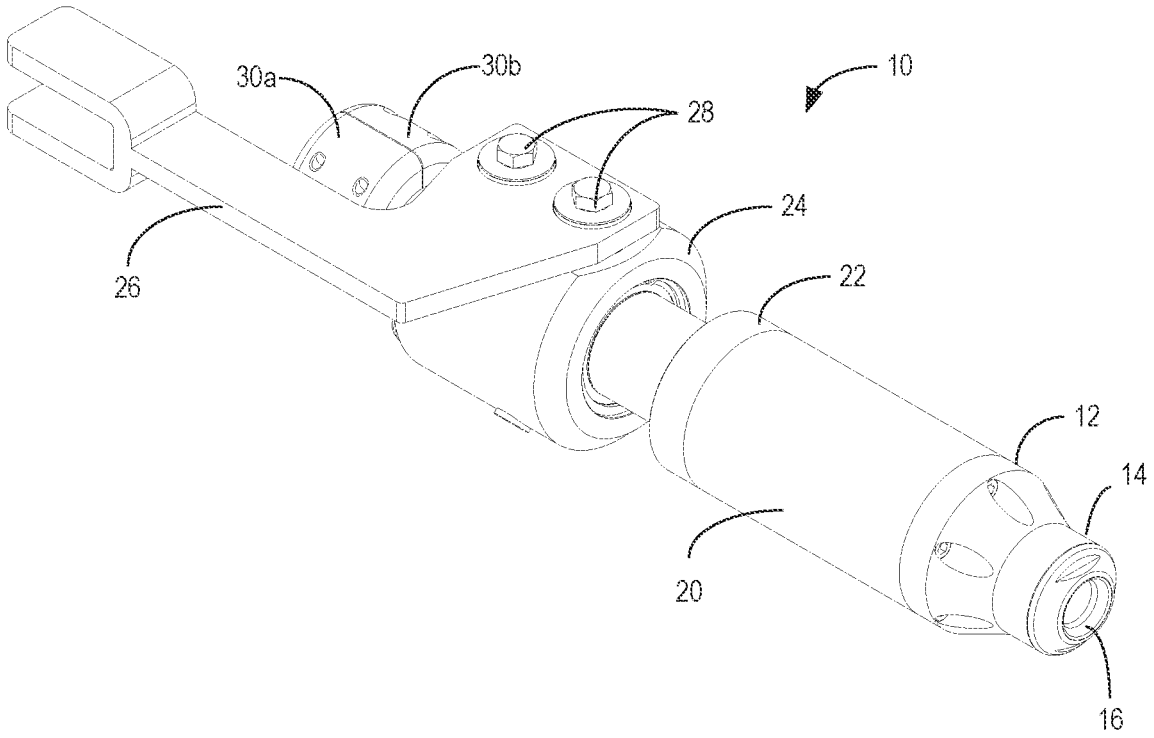
FIG. 1 is a transparent view of a dolly embodying aspects of the present invention.

Referring to the drawings FIG. 1 shows a dolly 10 for use in drilling, installing and resin injecting a rock bolt (not shown) using percussive force. The dolly 10 includes a percussion plate housing 12 and an associated percussion plate housing end cap 14 at its front or distal end 16 which, in use, engages and holds one end of a rock bolt, typically a self-drilling rock bolt. The percussion plate housing is mounted to a body portion 18 in the form of an input shaft 22 and associated shaft main body portion 20. A rotary coupling housing 24 extends around the input shaft 22 and an anti-spin arm 26 is attached to the rotary coupling housing, using bolts 28 or the like. At the proximal end of the dolly coupling clamps 30*a*, 30*b* are provided for attaching the dolly to the drive shaft of a rock bolting apparatus in the form of a bolter boom assembly 50 which is shown in FIGS. 2 and 3.

Figure 2:
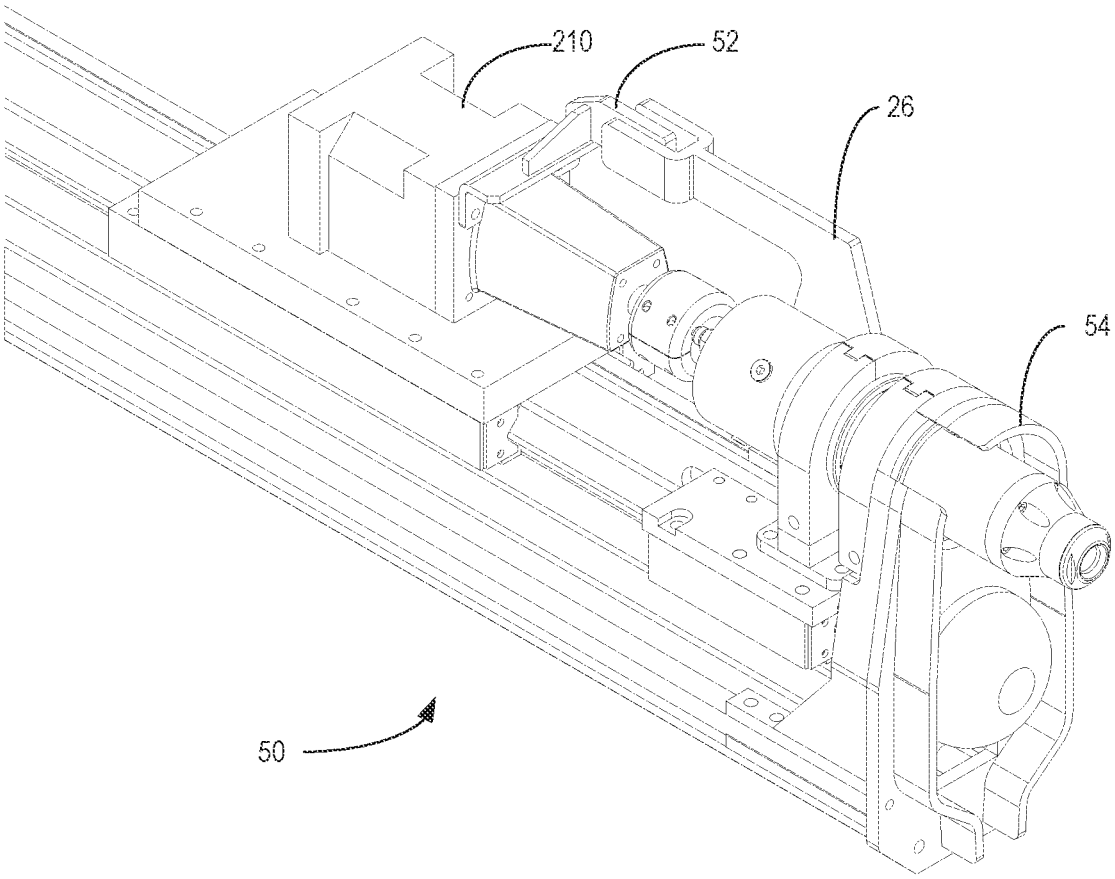
FIG. 2 shows the dolly attached to a modified rock bolt installation apparatus (bolter boom)
Figure 3:
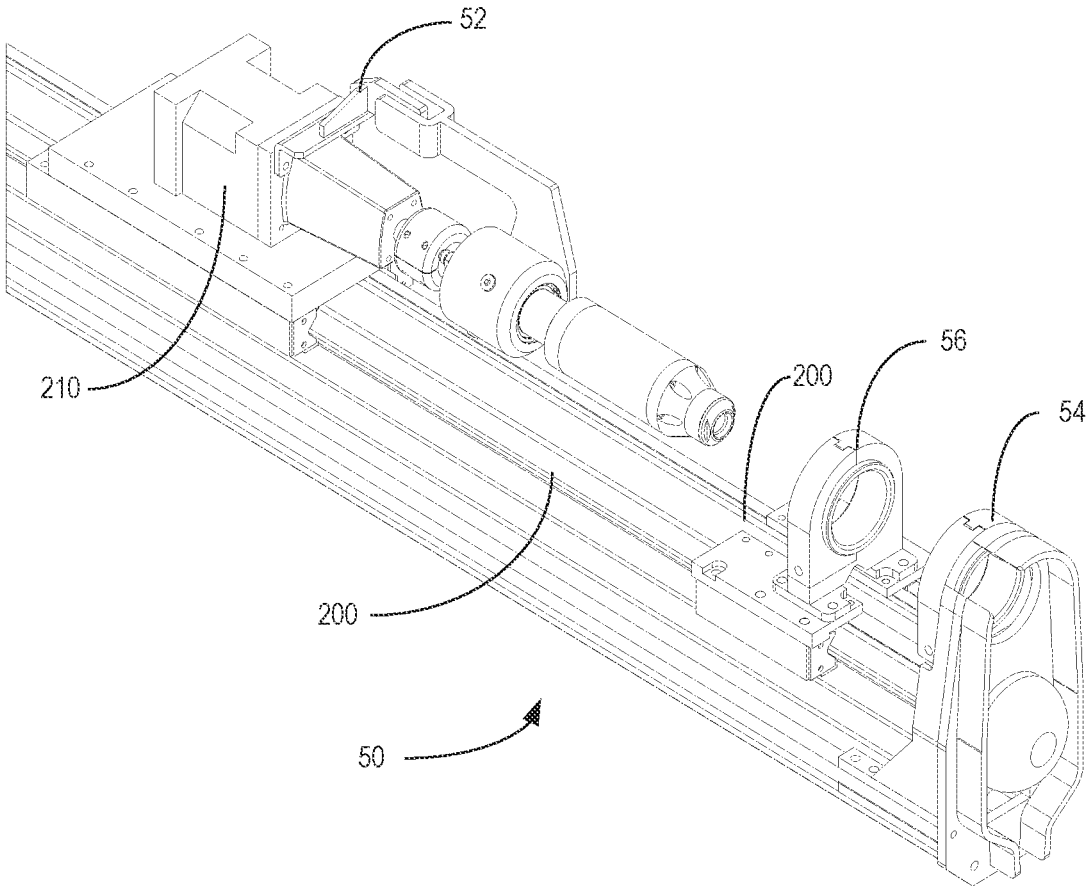
FIG. 3 is a similar view to FIG. 2 but showing the dolly retracted.

FIG. 2 shows the dolly 10 attached to a modified bolter boom assembly 50 (more specifically a Sandvik™ bolter arm assembly), although it will be appreciated that the dolly may be used with other models and OEM's drilling machines and forms of rock bolting apparatus/rock bolt installation equipment. FIG. 2 shows a number of non-standard modifications which have been made to the original bolter boom assembly 50 to accommodate the dolly which include a bracket 52, a fixed front guide means 54 in the form of a front centraliser, and a movable guide means 56 in the form of a moving centraliser, which function to guide the dolly so that the rock bolt can be maintained straight and in the correct orientation during drilling and installation of the rock bolt. FIG. 3 shows the same assembly as FIG. 2

Figure 4A:
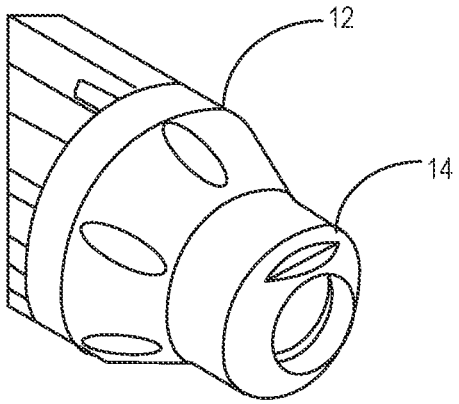
FIG. 4*a* shows in isometric view of the percussion plate housing of FIG. 4.
Figure 4B:
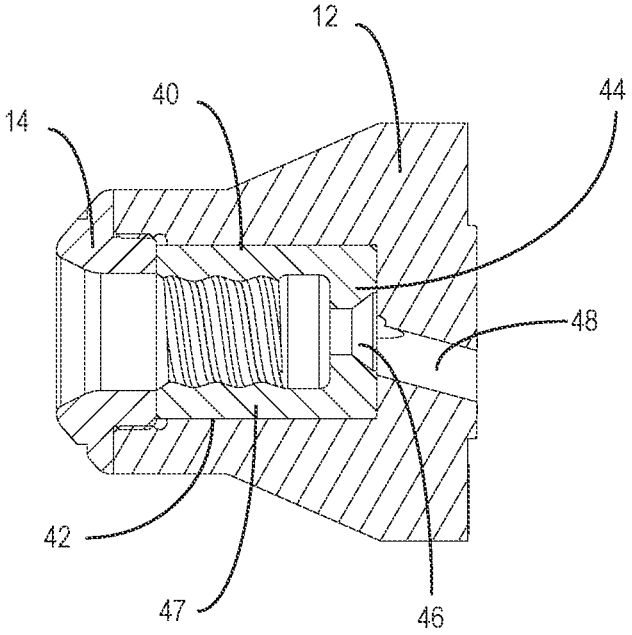
FIG. 4*b* shows a section through a percussion plate housing.

FIGS. 4*a* and 4*b* show the percussive plate housing 12 in more detail. As can be seen the housing 12 defines a cylindrical recess 40 in which a percussion plate 42 is housed. The percussion plate 42 is generally shaped like a beaker being cylindrical, and having a generally annular cross-section, with one end 44 being partly closed and defining an aperture 46 which is in fluid communication with a bore 48 extending through the housing. A seal, not shown ensures the connection between the aperture of the percussion plate 42 and bore 48 is water tight. The interior side walls 47 of the percussion plate are threaded with an R32 thread and contoured to engage with the proximal (non-drilling) end of a shank of a self-drilling rock bolt. This ensures a good connection and seal between the dolly and the rock bolt, in use. The end cap 16 screws into the end of the recess in the housing to retain the percussion plate in the housing.

The percussion plate including the internally threaded interior bore for receiving the R32 externally threaded end of the rock bolt allows percussive force, in addition to rotational forces, to be effectively transferred to the rock bolt. This allows the installation process to be quicker and more efficient.

The threaded end of the rock bolt simply screws into the percussion plate creating an effective connection which does not require seals or the like, when the resin and catalyst are being injected in the later stage of the installation process.

Figure 5:
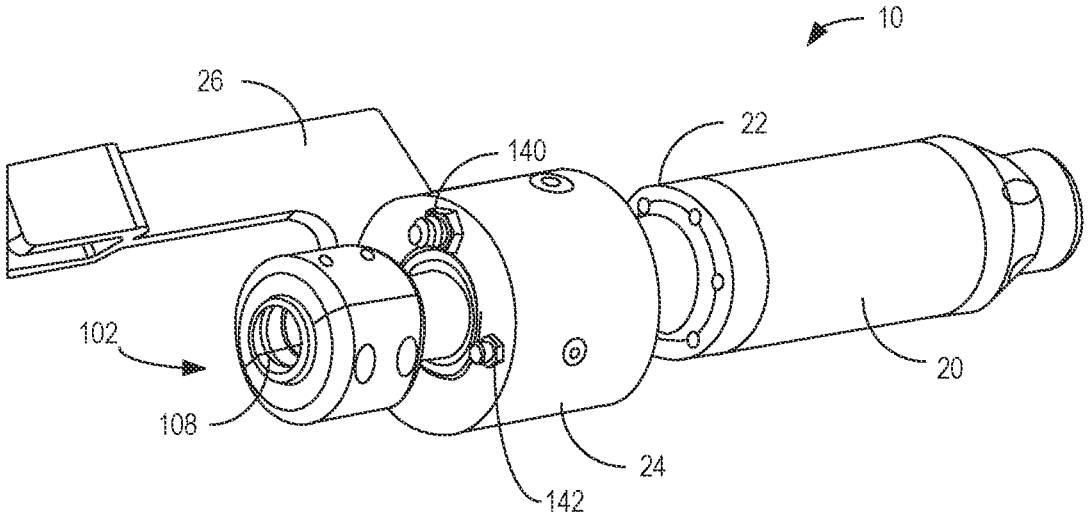
FIG. 5 shows part of the dolly illustrating the input shaft in red.

FIGS. 5 to 12 show the body portion 18 of the rock bolt dolly in more detail and illustrate in particular the pathways for the transmission of fluids through the input shaft 22 and means for coupling the input shaft with various different drive shafts using the coupling clamps 30*a*, 30*b*. In FIG. 5 the input shaft 22 is shown in red and, in particular, it can be seen that the end 102 of the shaft which engages with the drive shaft of a rock bolting apparatus such as a bolter arm or the like defines an cylindrical recess 104 in the form of a bore which is closed at one end apart from a central aperture 106. The interior of the recess is threaded and contoured to engage with the proximal (non-drilling) end of a shank of a self-drilling rock bolt. Also as best seen in FIG. 5, the annular part of the shaft defining the recess defines a longitudinal split 108 so that it can be expanded and/or compressed using clamps, as is described in more detail below, when engaging the dolly with a drive shaft. The clamping effect provides secure engagement to the shank allowing the use of left and right hand rotation of the dolly without disengaging.

Figure 6A:
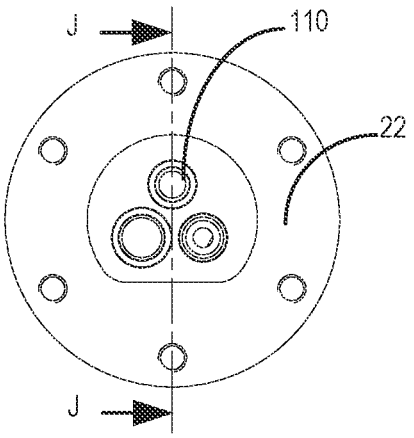
FIG. 6*a* is an end view of the input shaft shown in FIG. 5 showing section lines J-J.
Figure 6B:
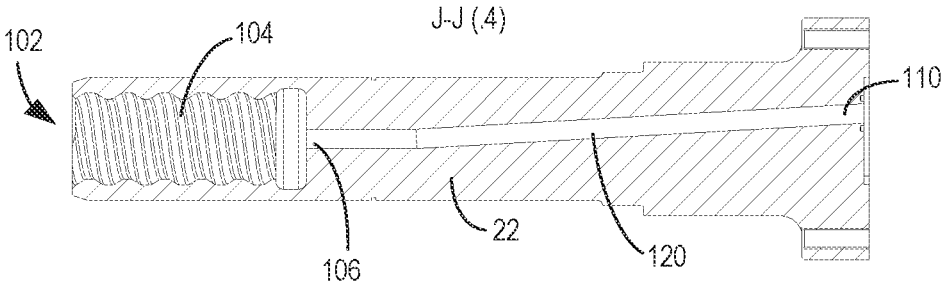
FIG. 6*b* is a section through the input shaft on J-J illustrating a water flushing pathway.

FIGS. 6*a*, 6*b* and 6*c* show end views of the input shaft 22 showing the distal or front end which connects to the shaft main body portion 20. The view shows the six holes which are used to bolt the two components together as well as the ends of three separate passageways/pathways for fluid which pass through the input shaft, namely the end of the water passageway 110, the end of the catalyst pathway 112, and the end of the resin pathway 114.

Figure 7A:
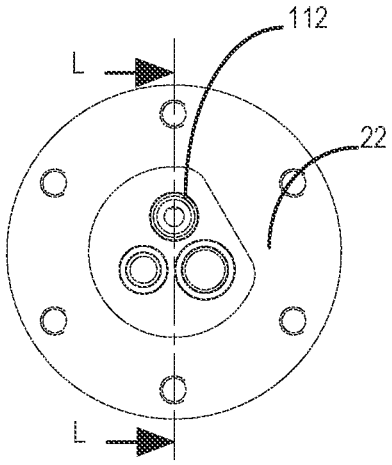
FIG. 7*a* is an end view of the input shaft of FIG. 5 showing section lines L-L.
Figure 7B:
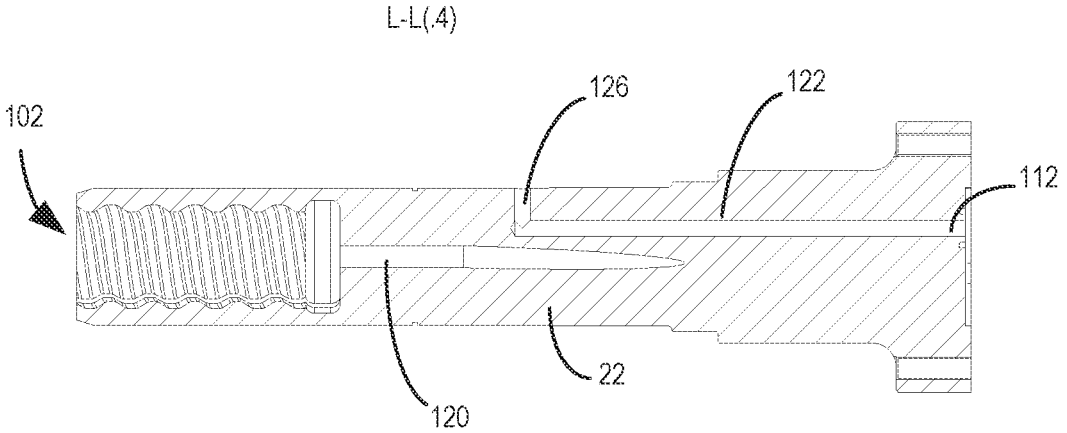
FIG. 7*b* is a section through the input shaft on L-L illustrating a catalyst pathway.
Figure 8A:
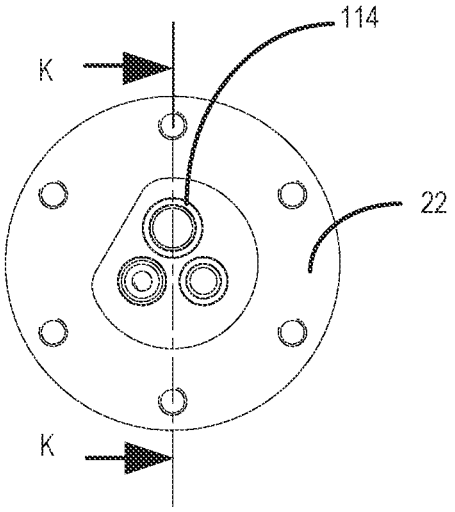
FIG. 8*a* is an end view of the input shaft of FIG. 5 showing section lines K-K.
Figure 8B:
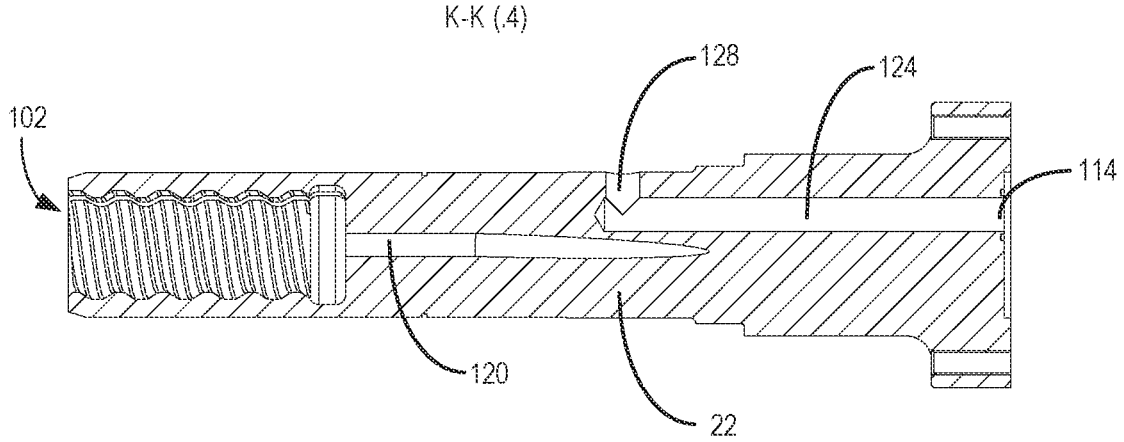
FIG. 8*b* is a section through the input shaft on K-K illustrating a resin mastic pathway.

With reference to FIG. 6*b*, it can be seen that the passageway 120 for water extends from the recess 104 to the front end of the shaft generally through the middle of the input shaft 22. As shown in FIG. 7*b*, the passageway 122 for catalyst is slightly narrower than the water passageway to account for mixing ratios and has a portion 126 which extends radially from the perimeter of the shaft toward the centre of the shaft and then along the central part of the shaft to the end 112. With reference to FIG. 8*b*, the passageway 124 for resin is larger in diameter than the water passageway and also has a portion 128 which extends radially from the perimeter of the shaft towards the centre of the shaft 22 and then along the central part of the shaft to the distal end of the shaft.

Figure 9:
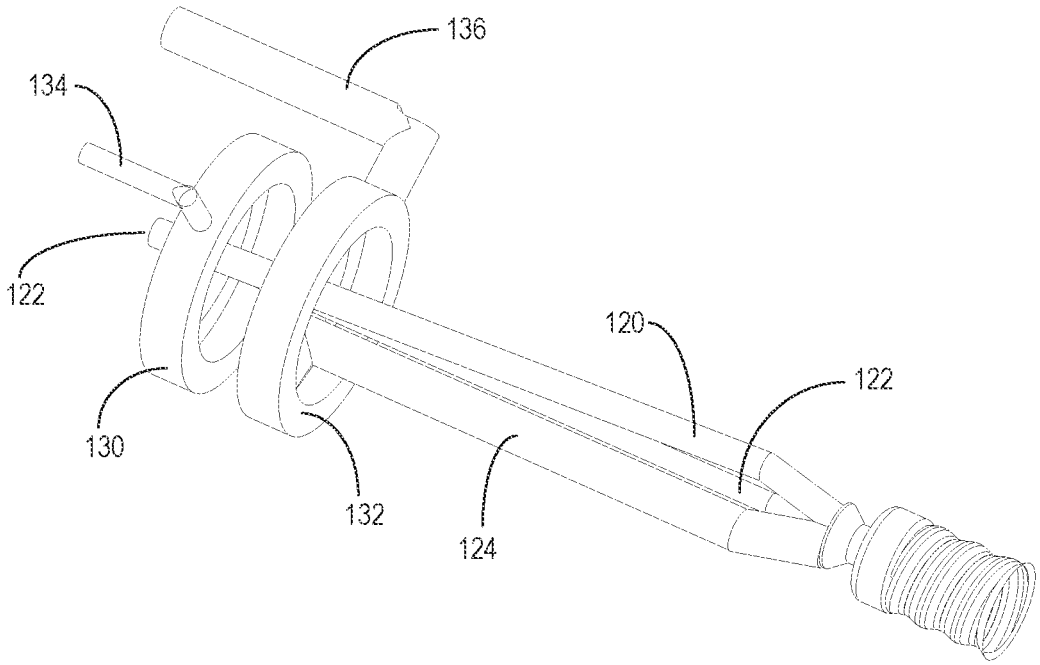
FIG. 9 is a schematic 3-d view showing the pathways for resin mastic and catalyst fluids through the dolly.
Figure 10:
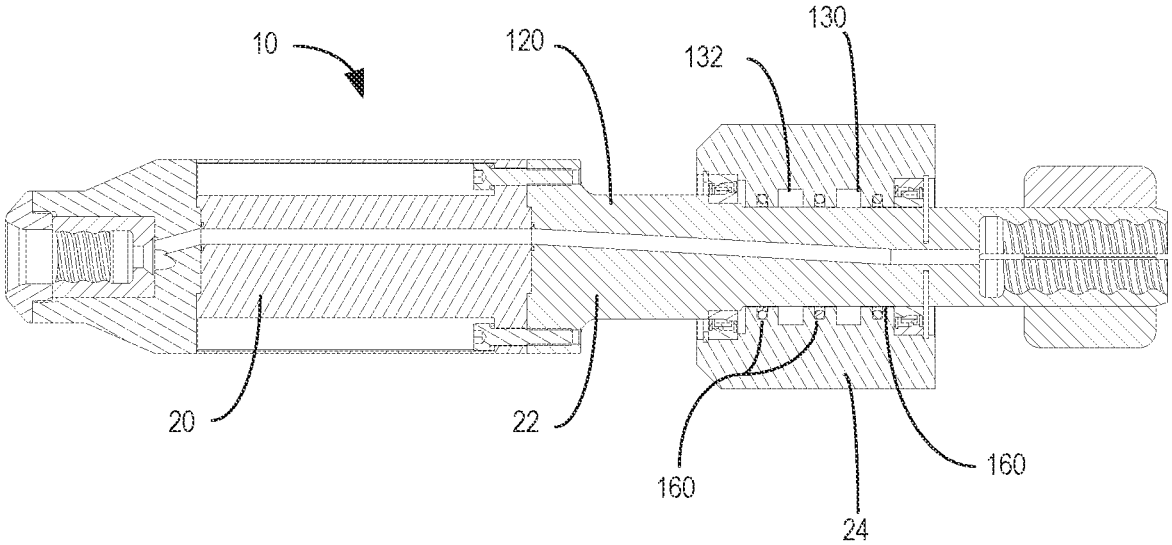
FIG. 10 is a cross-section through the dolly illustrating the water flushing pathway.

FIGS. 9 to 13 show the pathways for water, resin and catalyst through the dolly in more detail. In particular those figures show the rotary coupling housing 24 which encloses that section of the input shaft which defines the radial inlets to the catalyst and resin passageways. The water passageway simply extends directly along the length of the input shaft and percussive housing, from one end to the other. With reference to FIGS. 9 and 10 in particular, the resin and catalyst pass into the input shaft via the rotary coupling housing 24 which defines two axially spaced interior rings or circular passageways 130, 132 which coincide with the inlet 126 to the catalyst and inlet 128 to the resin passageways respectively. Note that in use the rotary housing 24 is prevented from rotating with the shaft by the engagement of the bracket 52 on the bolter drill with the anti-spin arm 22 attached to the rotary housing, and as the passageways 130, 132 are circular they are always in fluid communication with their respective inlet. The circular passageways may be connected to nipples 140 142 (best seen in FIGS. 5 and 11 and 12) on the exterior of the housing by passageways 134, 136 in the housing. The nipples are connected to supplies of catalyst and resin respectively by flexible hoses or the like. Pumps may be used to pump the resin and catalyst fluids through hoses and into the passageways.

Figure 11:
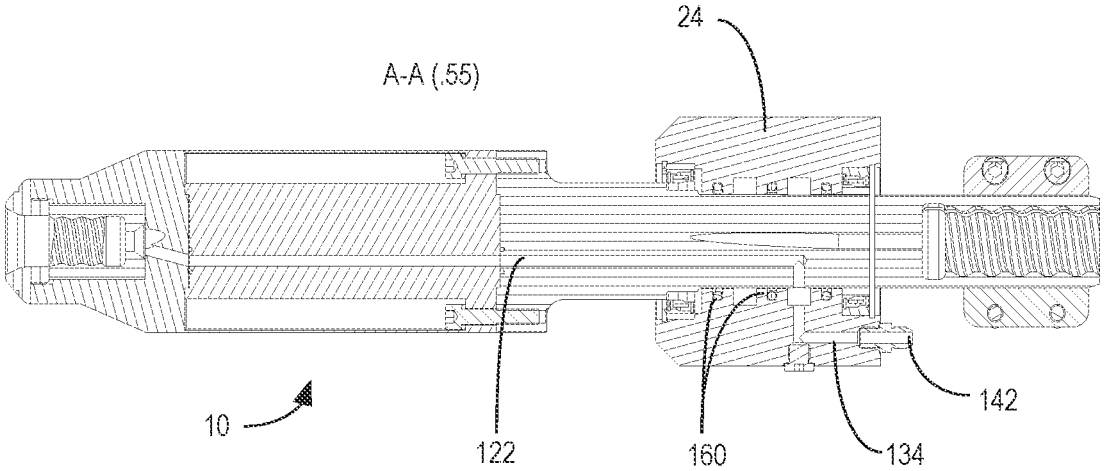
FIG. 11 is a cross-section through the dolly illustrating the catalyst pathway.
Figure 12:
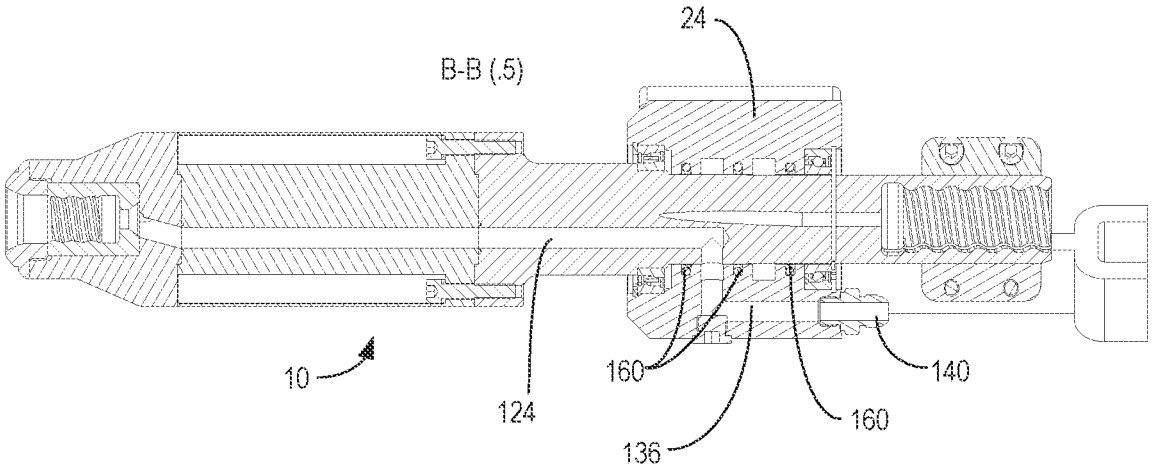
FIG. 12 is a cross-section through the dolly illustrating the resin mastic pathway.

As can be seen from FIGS. 11 and 12 in particular, self-lubricating seals 160, such as O-rings or the like, are provided between the axial sides of the passage ways and the input shaft.

Figure 14A:
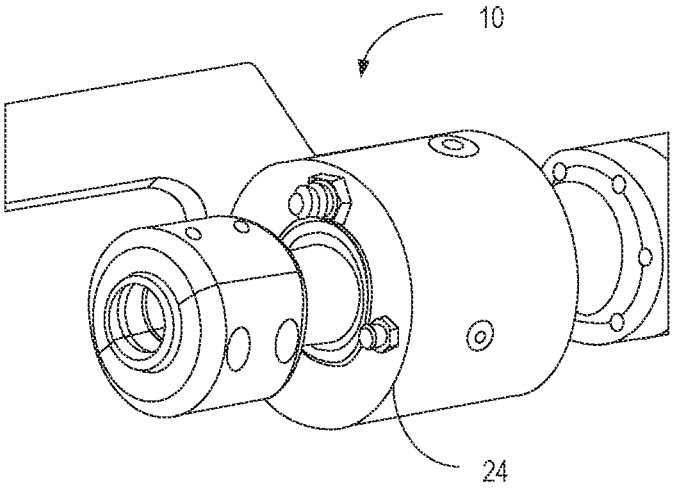
FIGS. 14*a* to 14*c* show a resin injection dolly coupling housing which prevents rotation of the hoses feeding resin and catalyst to the dolly.
Figure 14B:
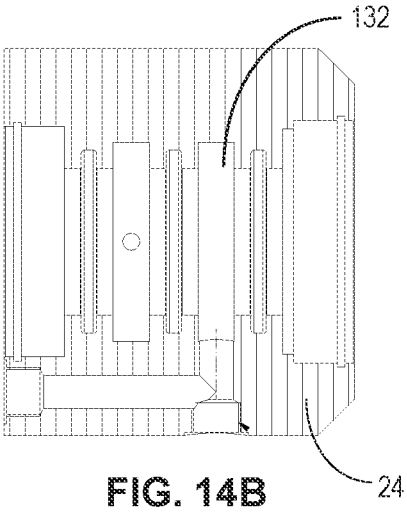
Figure 14C:
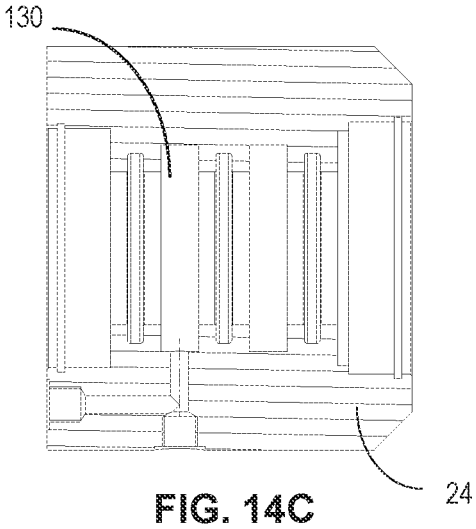

FIGS. 14*a* to 14*c* illustrates the flow pathways for resin and catalyst through the rotary coupling housing 24.

It is noted that the passageways have to be sized to allow the catalyst and resin fluids to flow through them under the pressure supplied by the pumps and depending on the viscosity of the fluids. In this respect it is noted that two pending PCT applications filed by J-LOK Co under numbers WO 2016/141008 and WO 2018/045277, and US patent publication number US 2020/0018165, the entire contents of which are incorporated by reference describe systems for pumping two component resins. In the described embodiment the diameter of the resin/mastic passageway 136-124 should be at least 10 mm, and may preferably be wider. The passageway 124 may be from 10 mm to 20 mm wide, more preferably between 10 and 15 mm wide to ensure that the passageway is wide enough to allow the resin to flow but not so wide as to weaken the structural integrity of the dolly. The dolly is designed for use with a polyester resin, rather than the less viscous polyurethane resin which is also used in mining applications.

With reference to US 2020/0018165, this describes a filled resin having 10-25% inert filler, such as limestone. The resin may have a viscosity of about 100,000 to 400,000 centipoise, most typically 125,000 to 225,000 cps which compares with polyurethane resin which has a viscosity of less than 10,000 centipoise.

The catalyst has a much lower viscosity of about 10,000 to 25,000 cps, so can be pumped through a much narrower bore.

Figure 13A:
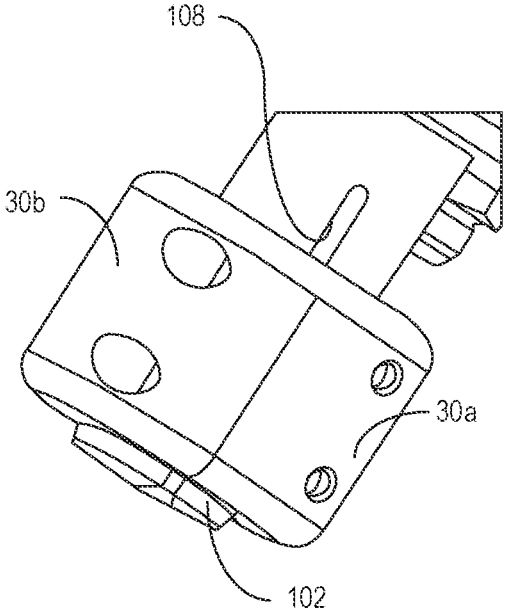
FIG. 13*a* is a side view of a coupling clamp for attaching a rock bolt to the dolly.
Figure 13B:
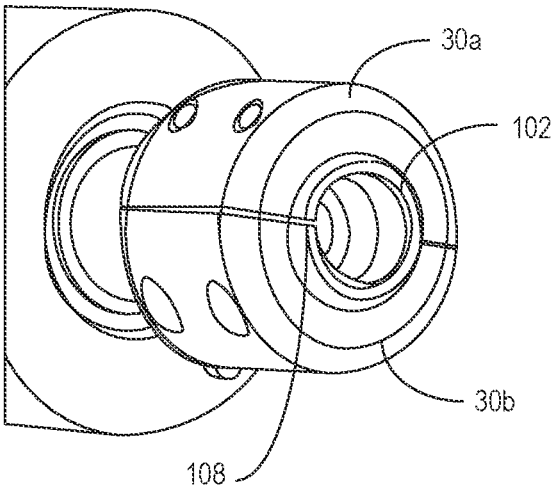
FIG. 13*b* is an isometric view of the coupling clamp shown in FIG. 13*a;*

Turning to FIGS. 13*a* and 13*b*, the semi-annular coupling clamps 30*a*, 30*b* allow the dolly to engage with various different drive shafts (also known as "drifter shanks"). As discussed above, the annular part of the shaft defining the recess which receives the drive shaft defines a longitudinal split 108 so that it can be expanded and/or compressed using the clamps 30*a* and 30*b* when engaging the dolly with a drive shaft. The clamps are tightened together to compress the annular end 102 of the input shaft using nuts and bolts or the like. The nuts are simply loosened when the clamps are to be disengaged.

Engagement with the drive shaft is by means of a direct left hand drive connection. When the resin injection process is complete (explained in more detail below) right hand rotation is required to disengage the dolly from the drive shaft. The clamps 22*a* and 22*b* allow the dolly to clamp onto the drive shaft while allowing for disengagement of the dolly from the rock bolt when using right hand rotation. Hence, the clamps allow both drilling and disengagement of the bolt with the dolly by using left and right rotations respectively.

Figure 15C:
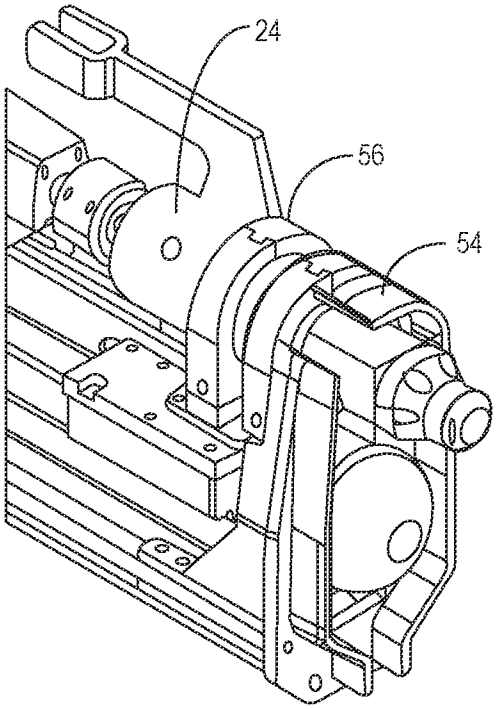
FIGS. 15*a* to 15*c* illustrate the moving centraliser of the dolly.
Figure 15B:
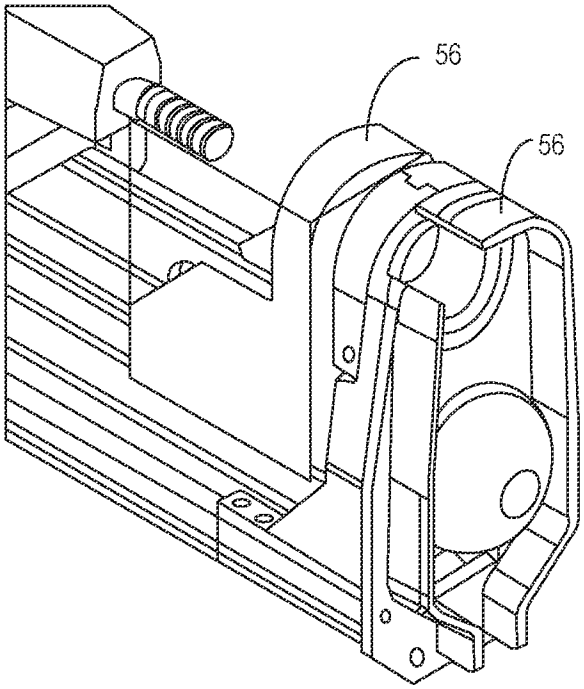
Figure 15A:
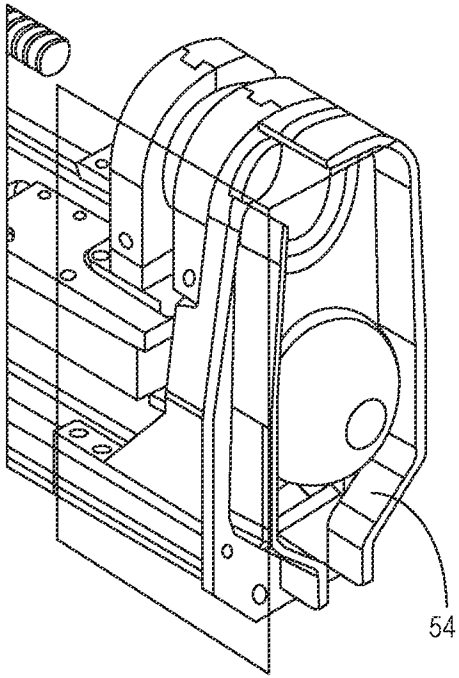

FIGS. 15*a* to 15*c* illustrate the fixed centraliser end plate 54 and moving centraliser 56 in more detail. These are in the form of a fixed and a moveable annular ring respectively and support and guide the extended rock bolt during the drilling process so that it is driven forwards along a straight axis without significant deviation. As is best seen in FIG. 3, the moving centraliser 56 is mounted for sliding on the rails 200 of the bolting boom on which the percussion housing 210 of the bolter arm is also mounted. The centralisers are large enough to allow the front parts of the dolly to pass through them, as far as the rotary housing and the moving centraliser moves forwards so that it abuts the fixed centraliser as shown in FIGS. 2 and 15*c*. This ensures adequate rock drilling depths can be achieved and reduces the tail length of the rock bolt remaining exposed.

Figure 16:
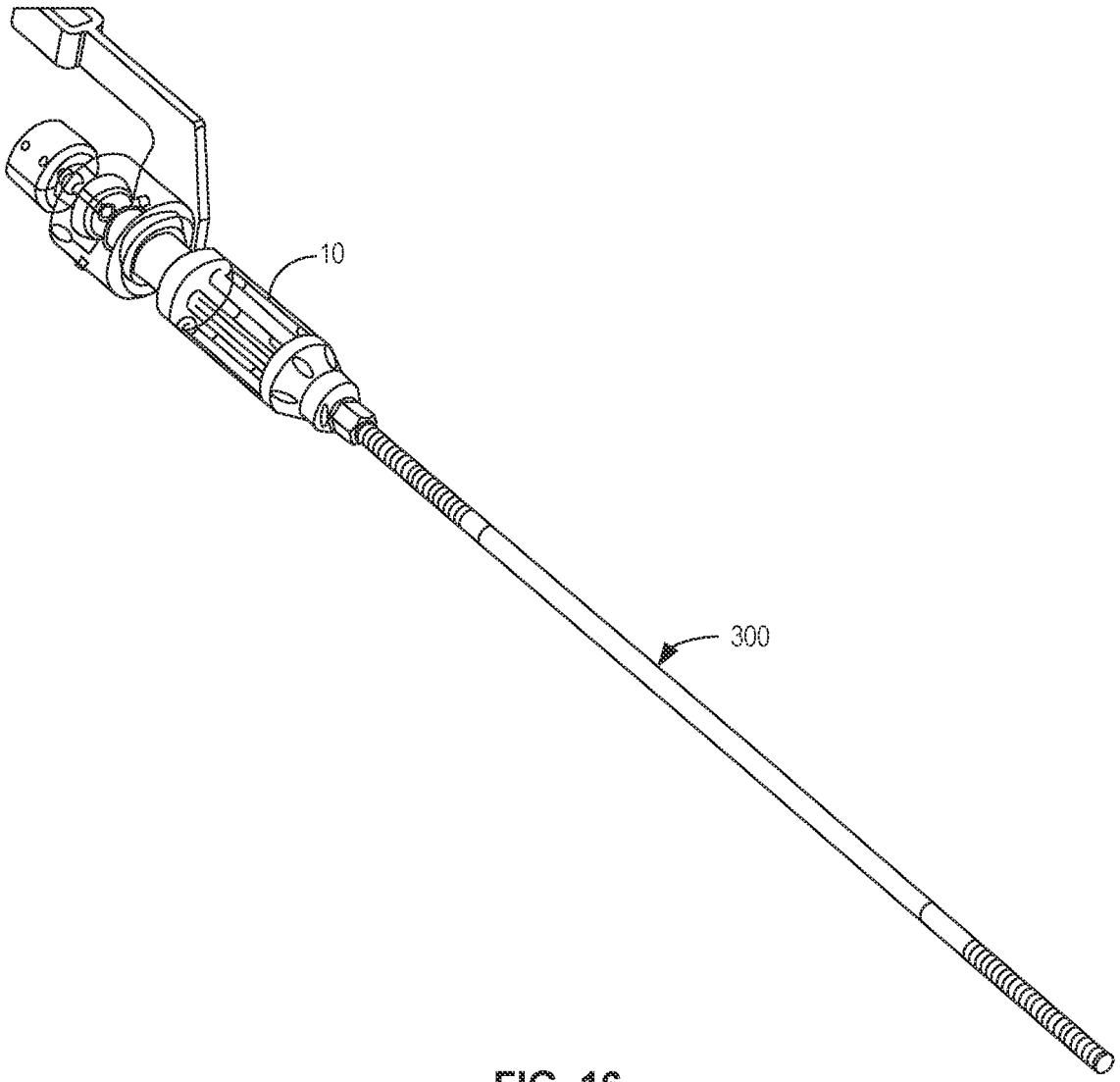
FIG. 16 is an isometric view of the dolly with the rod of a self-drilling rock bolt attached.
Figure 17:
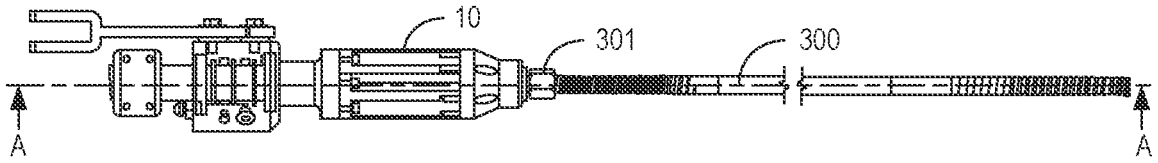
FIG. 17 is a side view of the dolly and rod shown in FIG. 16.
Figure 18:
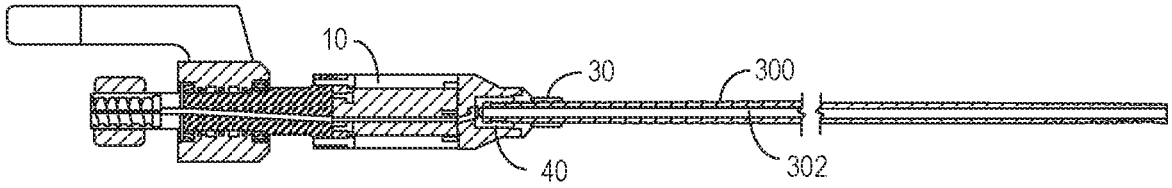
FIG. 18 is a section on A-A shown in FIG. 17.

In use the dolly 10 is attached to a bolter arm such as is shown in FIGS. 2 and 3. The coupling clamps 30*a*, 30*b* engage with the drive shaft of the percussion housing 210 of the bolter arm. The clamps allow both left and right hand rotation. With reference to FIGS. 16 to 18, a self-drilling rock bolt 300 is engaged with the percussion plate at the front or distal end of the dolly. The rock bolt comprises an elongate tubular rod having externally threaded (R32) ends. The proximal end carries a nut 301. The input shaft 22 and shaft main body 20 transfers percussive energy generated by the bolter arm to the percussion plate 42. The rock bolt is threaded into the percussion plate 42. and The dolly and rock bolt assembly rotates and impacts the rock bolt into rock using percussive energy and the drill bit (not shown) at the end of the self-drilling rock bolt, forming a borehole and drilling the hollow rock bolt into rock strata. During drilling water is continuously pumped down the central passageway 120 in the dolly into the rock bolt 300 and, in particular through the bore 302 in the hollow rod that forms the body of the rock bolt, and from there into the borehole to flush debris from the borehole. During this stage, the rotary housing is prevented from rotating with the input shaft by the anti-spin arm 26 and co-operating bracket 52 which engages with the arm 26

When the rock bolt 300 has been fully installed to the correct depth, the dolly remains coupled to the rock bolt 300 for resin injection. Resin and catalyst are then injected though the passageways in the dolly into the bore 202 of the rock bolt and pass into the borehole, where they mix and harden. The bolt 300 remains stationary at this time and a static mixer located inside the rock bolt mixes the resin and catalyst together. The threaded engagement of the percussion plate and bolt 300 inhibits the leakage of the resin and catalyst being pumped through the dolly to the rock bolt 300. Once the resin has cured after resin injection, the dolly is disengaged from the rock bolt 300 and flushed with water using the water passageway. The rock bolt 300 remains bonded to the bore hole with cured resin. The process is then repeated with the next self-drilling rock bolt.

Advantageously, the present invention may allow an operator to use percussive energy to drill rock bolts into strata and rock and directly inject grout such as a two part resin directly into the rock bolt and borehole to encapsulate the rock bolt within the borehole without having to disengage the rock bolt form the installing dolly until the end of the installation process, using a single pass installation method.

More particularly, the system avoids the step or need to uncouple the rock bolt prior to injecting resin into the rock bolt/borehole. As a consequence, installation is faster and more efficient. The system is more reliable and may provide improved quality control and installation. Water flushing occurs directly at the bolt connection point.

The system may be used on both Bolting and Jumbo drill rigs and can be provided to suit various OEM drill brands.

Advantageously the dolly design is relatively uncomplicated, requiring only one port for resin/mastic and one port for the catalyst as the water is flushed down the centre of the dolly as is normal in installing rock bolts. The dolly also does not require any internal control valves, and is compatible with standard bolting machine drive shafts.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A rock bolt dolly arranged to connect a self-drilling rock bolt including a elongate hollow rod defining at least one externally threaded end, to a rock bolting apparatus and arranged to transfer percussive energy applied to the dolly by the rock bolting apparatus to the rock bolt during installation of the rock bolt in strata and rock, the dolly comprising:

coupling means for coupling the dolly to the output shaft of the rock bolting apparatus;

a percussion plate comprising an end plate and integral side walls defining an internally threaded recess for receiving the threaded end of the rock bolt, for applying percussive loading to the elongate hollow rod of the rock bolt via the end plate and threaded side walls;

a body portion extending between the coupling means and the percussion plate transmitting forces from the output shaft to the percussion plate; wherein the body portion defines at least one passageway for the passage of grout from a reservoir through the rock bolt dolly and into the rock bolt.

2. A rock bolt dolly as claimed in claim 1 wherein the body portion defines at least two passageways, one passageway for supplying catalyst and one passageway for supplying resin to the rock bolt.

3. A rock bolt dolly as claimed in claim 2 wherein the diameter of the passageway for supplying resin is at least about 10 to 20 mm diameter, most preferably at least 10 to 15 mm diameter.

4. A rock bolt dolly as claimed in any preceding claim wherein the body portion further defines a passageway for supply of water to the percussion plate.

5. The rock bolt dolly as claimed in claim 1 wherein the grout is supplied to the passageway in the body portion via a rotary housing which extends around the body portion and is rotatable relative to the body portion and which is prevented from rotating relative to the output shaft to provide a non-rotating connection point for a hose for supplying grout to the dolly.

6. The rock bolt dolly as claimed in claim 5 wherein the rotary housing defines an annular passageway which is in constant fluid connection with a radial inlet in the body portion of the dolly.

7. The rock bolt as claimed in claim 1 wherein the body portion defines at least two passageways, one passageway for supplying catalyst and one passageway for supplying resin to the rock bolt and wherein the resin and catalyst are supplied to the passageways in the body portion via a rotary housing which extends around the body portion and is rotatable relative to the body portion and which is prevented from rotating relative to the output shaft to provide a non-rotating connection point for a hose for supplying grout to the dolly.

8. The rock bolt dolly as claimed in claim 7 wherein the rotary housing defines a first annular passageway which is in constant fluid connection with a first radial inlet to the catalyst passageway in the body portion of the dolly and a second annular passageway which is in constant fluid connection with a second radial inlet to the resin passageway in the body portion of the dolly.

9. The rock bolt dolly as claimed in claim 1 wherein the coupling means comprise a clamp which can be located around the output shaft and tightened to engage the dolly with the output shaft.

10. The rock bolt dolly as claimed in claim 9 wherein the clamp comprises two generally C-shaped clamp elements connected via a threaded connection, such as nuts and bolts, for contracting and/or expanding the clamp, and wherein the body portion of the dolly defines an annular section whose interior is contoured for engagement with the output shaft of the dolly and wherein the annular section defines a longitudinal slot so that it may be compressed around the output shaft by the clamp.

11. A method of installing a rock bolt comprising:

drilling a borehole in strata and/or rock using a self-drilling rock bolt connected to a bolter boom or the like using a dolly as claimed in claim 1;

while the self drilling rock bolt remains in the borehole, injecting grout into the borehole via a passageway in the dolly and in the self drilling rock bolt; and disconnecting the self-drilling rock bolt from the dolly.

12. The method of claim 11 wherein the self-drilling rock bolt remains engaged with the self-drilling rock bolt during the step of injecting grout into the borehole via the dolly and the self-drilling rock bolt.

13. The method of claim 11 wherein the grout comprises resin and a catalyst, said method further comprising:

supplying the resin via a resin pathway in the dolly; and supplying the catalyst via a catalyst pathway in the dolly, separate from the resin pathway.

14. The method of claim 11 further including the step of disconnecting the rock bolt from the dolly after the resin has cured and flushing the dolly with water via a passageway in the dolly.

15. The method of claim 13 wherein the resin passageway in the dolly has a diameter of at least about 10 mm and wherein the resin has a viscosity of between 100,000 and 400,000 centipoise and preferably 125,000 to 225,000 centipoise.

16. The method of claim 15 wherein the resin is a polyester resin, typically including from 10 to 25% by weight of an inert filler.

17. An assembly comprising a rock bolting apparatus and a dolly as claimed in claim 1.

18. The assembly as claimed in claim 17 wherein the rock bolting apparatus defines a fixed front guide for the dolly and a moveable guide for the dolly.

19. A method of using a dolly to install a self-drilling rock bolt in strata and/or rock, the self drilling rock bolt including a elongate hollow rod defining at least one externally threaded end, the method using the dolly to transfer percussive energy applied to the dolly by the rock bolting apparatus to the rock bolt during installation of the rock bolt in strata and rock, wherein the dolly comprises:

coupling means coupling the dolly to the output shaft of the rock bolting apparatus;

a percussion plate comprising an end plate and integral side walls defining an internally threaded recess for receiving the threaded end of the rock bolt, for applying percussive loading to the elongate hollow rod of the rock bolt via the end plate and threaded side walls;

a body portion extending between the coupling means and the percussion plate transmitting forces from the output shaft to the percussion plate; wherein the body portion defines a first passageway having a diameter of for the passage of resin through the rock bolt dolly and into the rock bolt, and a second passageway for the passage of catalyst through the rock bolt dolly and into the rock bolt, wherein the diameter of the first passageway is at least about 10 mm, the method including the steps of:

drilling a borehole in strata and/or rock using the self-drilling rock bolt connected to the rock bolting apparatus via the dolly;

while the self-drilling rock bolt remains in the borehole, injecting resin into the borehole and rock bolt via the first passage passageway in the dolly and injecting catalyst into the borehole and rock bolt via the second passage passageway in the dolly wherein the resin comprises a polyester resin having a viscosity of from 100,000 to 400,000 centipoise; and disconnecting the self-drilling rock bolt from the dolly.

20. The method as claimed in claim 19 wherein the polyester resin, typically includes from 10 to 25% by weight of an inert filler, typically limestone.

* * * * *